US009950825B2

(12) United States Patent
Concetti

(10) Patent No.: US 9,950,825 B2
(45) Date of Patent: Apr. 24, 2018

(54) FILING BAGS WITH ADJUSTMENT OF OPENING/CLOSING TRAVEL OF BAG-HOLDER VALVES

(71) Applicant: Concetti S.p.A., Bastia Umbra (PG) (IT)

(72) Inventor: Teodoro Concetti, Bastia Umbra (IT)

(73) Assignee: Concetti S.p.A., Bastia Umbra (PG), (IT)

( * ) Notice: Subject to any disclaimer, the term of this patent is extended or adjusted under 35 U.S.C. 154(b) by 146 days.

(21) Appl. No.: 14/677,021

(22) Filed: Apr. 2, 2015

(65) Prior Publication Data

US 2015/0284123 A1 Oct. 8, 2015

(30) Foreign Application Priority Data

Apr. 4, 2014 (IT) ..... MI2014A0605

(51) Int. Cl.
*B65B 59/02* (2006.01)
*B65B 1/02* (2006.01)
(Continued)

(52) U.S. Cl.
CPC ..... *B65B 59/02* (2013.01); *B65B 1/02* (2013.01); *B65B 1/04* (2013.01); *B65B 7/025* (2013.01);
(Continued)

(58) Field of Classification Search
CPC ..... B65B 59/02; B65B 37/02; B65B 39/001; B65B 7/025; B65B 43/30; B65B 39/06; B65B 43/32; B65B 1/02; B65B 59/00; B65B 39/02; B65B 1/04; B65B 39/002; B65B 51/10; B65B 5/045; B65G 17/323
(Continued)

(56) References Cited

U.S. PATENT DOCUMENTS 3,750,721 A * 8/1973 Hudson ..... B65B 39/02 141/10
3,830,266 A 8/1974 Hudson
(Continued)

FOREIGN PATENT DOCUMENTS

GB 2020618 A 11/1979
WO WO-2007049913 A1 5/2007
WO WO-2011107400 A1 9/2011

*Primary Examiner* — Jason K Niesz
*Assistant Examiner* — James Hakomaki
(74) *Attorney, Agent, or Firm* — Mintz Levin Cohn Ferris Glovsky and Popeo, P.C.

(57) ABSTRACT

An apparatus is for filling bags having a bag mouth extending in a direction of width with loose material. The apparatus includes grippers, suction cups, valves, and a pair of first carriages. The grippers are for gripping opposite edges of a bag, which are arranged opposite each other relative to a vertical axis of symmetry and are movable symmetrically towards and/or away from each other with respect to said vertical axis of symmetry in a direction parallel to the direction of width of the bag. The suction cups are for gripping side portions of the bag. The suction cups are movable symmetrically towards and/or away from each other along a direction perpendicular to the direction of width of the bag for opening and/or gripping the bag mouth of the bag. The valves can rotate from a closing position outside the bag into an opening position inside the bag mouth.

11 Claims, 4 Drawing Sheets

(51) Int. Cl.

| | |
|---|---|
| ***B65B 39/06*** | (2006.01) |
| ***B65B 43/32*** | (2006.01) |
| ***B65B 39/00*** | (2006.01) |
| ***B65B 43/30*** | (2006.01) |
| ***B65B 1/04*** | (2006.01) |
| ***B65B 59/00*** | (2006.01) |
| ***B65B 37/02*** | (2006.01) |
| ***B65B 39/02*** | (2006.01) |
| ***B65B 7/02*** | (2006.01) |
| ***B65B 51/10*** | (2006.01) |

(52) U.S. Cl.
CPC ..... *B65B 37/02* (2013.01); *B65B 39/001* (2013.01); *B65B 39/002* (2013.01); *B65B 39/02* (2013.01); *B65B 39/06* (2013.01); *B65B 43/30* (2013.01); *B65B 43/32* (2013.01); *B65B 59/00* (2013.01); *B65B 51/10* (2013.01)

(58) Field of Classification Search
USPC ..... 141/10, 114, 316; 53/386.1, 570, 502, 53/459
See application file for complete search history.

(56) References Cited

U.S. PATENT DOCUMENTS

| | | | | |
|---|---|---|---|---|
| 4,526,214 | A * | 7/1985 | McGregor | B65B 1/28 141/114 |
| 4,537,013 | A | 8/1985 | Tetenborg et al. | |
| 5,448,879 | A * | 9/1995 | Concetti | B65B 1/02 53/284.7 |
| 6,964,146 | B2 * | 11/2005 | LaRocca | B65B 43/18 53/386.1 |
| 2004/0182469 | A1 * | 9/2004 | Concetti | B65B 1/02 141/10 |
| 2010/0281822 | A1 | 11/2010 | Murray | |

* cited by examiner

PRIOR ART

FILING BAGS WITH ADJUSTMENT OF OPENING/CLOSING TRAVEL OF BAG-HOLDER VALVES

RELATED APPLICATION

This application claims priority under 35 U.S.C. § 119 to Italian Patent Application No. MI2014A000605 filed on Apr. 4, 2014, the entire contents of which are expressly incorporated by reference herein.

TECHNICAL FIELD

The present subject matter relates to filling bags with adjustment of the opening/closing travel of bag-holder valves. Related apparatus, systems, techniques, and articles are also described.

BACKGROUND

It is known in the products sector relating to the packaging of loose material that there exists the need to arrange the material inside bags, which must be filled with a given and defined quantity of material and then sealed. It is also known that, for this purpose, automatic bag filling machines have been developed, an example of the machines consisting of so-called forming and filling machines which are able to perform at high speed the cycle involving forming of the bag, filling of the bag and final sealing of the bag mouth. The machines comprise in particular a station for filling the bag with the material contained inside a hopper arranged in a position substantially coaxial with the bag itself and at a height greater than the height of the bag mouth.

FIGS. 1 and 2 show a form-fill-seal (FFS) machine (also indicated below as FRS) with a forming station F, a filling station R with fixed grippers for gripping the bag engaged with the product feeding mouth, which station is provided with rotating valves able to open and close, a station S for sealing the bag mouth, and a conveyor 115 for conveying out of the machine the filled and sealed bag. FIG. 2 shows in schematic form the working sequence performed by means for conveying the bag from one station to another with opening of the mouth, closing of the mouth after filling, and sealing of the mouth with release by the grippers.

Also known, however, are filling machines—also indicated below as RGS—in which the bag is pre-formed and stored in a feeder from which it is removed and directly conveyed to the filling station.

Also known, both in the case of these latter machines and in the case of FFS machines, is an opening sequence of the bag mouth performed in the filling station R by means of suction cups for gripping the opposite side portions of the bag mouth which are fixed in the direction of feeding of the bag and movable in the direction perpendicular to the latter and grippers which instead are fixed in the transverse direction orthogonal to the direction of feeding of the bag and movable only in the direction of feeding of the bag so as to accompany the reduction in the width dimension of the mouth of the bag, following opening thereof.

However, for both types of known machines, the opening and closing movement of the bag mouth by means of the supporting grippers and of the suction cups for gripping the side portions of the bag is fixed by a start-of-cycle set-up operation depending on the minimum width dimension of the bags, which can be processed and remains fixed for all the possible different sizes of the bags processed by the machine. Correspondingly, also opening of the bag-holder device valves which enter into the mouth of the latter, once it has been opened, adhering to and tensioning its side portions so as to prevent material from escaping during filling, remains in turn fixed, again depending on the width of the bag being processed.

This means that, when there is a variation in the dimensions of the bag and in particular in its width, it may not be possible in a technically speaking reasonable amount of time and with reasonable efforts to modify the discharge cross-section of the feeding mouth without a further set-up operation which requires stopping the machine, disassembling its parts and manually adjusting the various positions before being able to start/restart production.

In the technical sector of filling machines also known are other types of machines called bagging machines for pre-formed bags in which the filling station includes means for adjusting opening of the valves of the bag-holder device depending on the size of the bag being processed. These adjustment means substantially consist of a selector, the relative positions of which determine different positions for stopping the opening rotational movement of the valves.

These types of machines, however, also have drawbacks due to the fact that, on the one hand, they require different set-ups for normal bags and gusseted bags, set-ups requiring the installation of different mechanical elements for the two bag types at the start of the cycle and, on the other hand, opening of the bag-holder valves takes place in the direction transverse to feeding of the bag, with the result that opening of the valves must necessarily be adapted to the size of the smallest gusset, thereby reducing the filling rate with a consequent increase in the cycle time when the gusset size is very small, with a reduction in the efficiency of the machine, which is particularly disadvantageous for the larger size bags which instead would require a higher filling speed in order not to penalize the overall production efficiency. In addition, handling of the gusseted bags requires that the folds of the gusset be opened at the time of filling and then folded back up again by means of a particularly delicate procedure.

The known methods consequently result in possible high operational downtimes of the machine, a reduction in the production capacity with a consequent increase in the unit production cost, as well as the need for personnel who are specialized and trained in performing retooling of the filling station.

U.S. Pat. No. 3,830,266A discloses an apparatus for filling with loose material bags having a mouth extending in a direction of width.

SUMMARY

One technical problem posed therefore is that of providing an apparatus for machines for filling bags with loose material which, when there is a variation in the width size of the bag, is able to modify the relative positions of the grippers for gripping the opposite edges of the bag and the angle of rotation of the bag-holder valves in an automatic and synchronized manner upon simple operation of actuators controlled by means for programming, controlling and executing the operating sequences of the machine. In connection with this problem it is also required that this apparatus can have small dimensions, can be easy and inexpensive to produce and assemble and can be able to be easily installed also on ready existing machines.

These results are obtained according to the present subject matter by an apparatus for filling bags with adjustment of the opening/closing travel of the valves of the bag-holder device.

In an aspect, an apparatus is provided for filling bags having a bag mouth extending in a direction of width with loose material. The apparatus includes grippers, suction cups, valves, and a pair of first carriages. The grippers are for gripping opposite edges of a bag, which are arranged opposite each other relative to a vertical axis of symmetry and are movable symmetrically towards/away from each other with respect to said vertical axis of symmetry in a direction parallel to the direction of width of the bag. The suction cups are for gripping side portions of the bag. The suction cups are movable symmetrically towards/away from each other along a direction perpendicular to the direction of width of the bag for opening/gripping the bag mouth of the bag. The valves can rotate from a closing position outside the bag into an opening position inside the bag mouth of the bag. The pair of first carriages are arranged opposite each other and movable in the direction of width of the bag symmetrically with respect to the vertical central axis of symmetry, from a minimum/maximum spaced position to a maximum/minimum spaced position. Fixed to each first carriage is a flange extending in the direction of width of the bag towards the vertical axis of symmetry and designed to form an end-of-travel stop surface for rotation of the valves. The grippers are for gripping opposite edges of the bag. An initial relative distance with respect to the vertical axis of symmetry between the flange and the grippers is constant and independent of the width of the bag. The flange of each first carriage is designed to form an adjustable stop surface for end-of-travel of rotation for opening and entry into the bag mouth of the valves. Movements for positioning the two first carriages, the flange for the rotation of the valves and the grippers for gripping edges of the bag are coordinated and performed by a single start-of-cycle command depending on the width-wise dimension of the bag.

In another aspect, there is method for adjusting a relative engagement between a bag mouth of a bag and valves of a filling apparatus for filling bags with loose material. The filling apparatus includes grippers, suction cups, a bag-holder device, and flanges. The grippers are for gripping opposite edges of the bag, which are arranged opposite each other relative to a vertical axis of symmetry and movable symmetrically towards/away from each other with respect to said axis in the direction parallel to direction of width of the bag. The suction cups are for gripping side portions of the bag. The suction cups are movable symmetrically towards/away from each other along the direction perpendicular to the direction of the width of the bag for opening/gripping the mouth of the bag. The bag-holder device has valves rotating from a closing position outside the bag into an opening position inside the mouth of the bag. The flanges are arranged opposite each other and extending in the direction of width of the bag towards the axis of symmetry and designed to form an end-of-travel stop surface for opening rotation and entry into the bag mouth of the valves of the bag-holder device. The method includes determining the width of the bag to be fed to the filling station. The flanges are symmetrically positioned for the valves at a relative distance so as to determine opening of the valves in the direction of the width of the bag, such as to ensure sealing contact between inner surfaces of the open mouth of the bag and the valves. The grippers for gripping opposite edges of the bag are symmetrically positioned at a relative distance compatible with the width of the bag in order to perform gripping thereof. The bag is fed to the filling station at a height lower than that of a bottom edge of the valves in the closing position. The valves are rotated as far as the respective end-of-travel position. An initial relative distance with respect to the axis of symmetry between the flanges and the grippers is constant and independent of the width of the bag. Positioning of the grippers causes the simultaneous positioning of the flanges of the valves. Opening of the valves causes their movement from a position outside and above the mouth of the bag to a position inside the latter and in close contact with the inner surfaces of the said mouth. The movements for positioning the flanges for rotation of the valves and the grippers for gripping edges of the bag are coordinated and performed by a single start-of-cycle command depending on the width-wise dimension of the bag.

One or more of the following features can be included in any feasible combination. For example, the bag mouth can be situated at a height in the vertical direction lower than that of bottom edges of the valves in the closing position. A travel of the first carriages can be programmable at a start of a cycle depending on the width of the bag. Each first carriage can have a respective guide, which extends parallel to the direction of width and supports a respective second carriage for supporting the grippers, which is displaceable in the direction of width symmetrically with respect to the vertical axis of symmetry. A travel of the second carriages can be fixed and independent of the width of the bag. The valves can be hinged on a respective pin about which they rotate in both opening/closing directions upon operation of a cylinder which can be fixed to a structure of the machine and a rod of which can be pivotably mounted on one side of the valve. The first carriages can be displaceable on rollers engaged on a fixed guide extending parallel to the direction of width and joined together with a structure of the machine.

Movement of the first carriages can be performed by a gearmotor which rotationally drives a threaded bar on which two lead screw brackets respectively integral with one or the other of the two first carriages can be engaged. The threaded bar can have sections on opposite sides of the axis of symmetry with oppositely wound threading. The grippers can have jaws movable to open/close in the direction perpendicular to the direction of width for gripping/releasing the side edges of the mouth of the bag, opening/closing of the jaws can be performed by a rod suitably displaced by a cylinder in turn integral with the first carriage.

The flanges for rotation of the valves and the grippers for gripping the edges of the bag can be mounted on respective first carriages arranged opposite each other and movable, in the direction of width of the bag symmetrically with respect to the vertical central axis of symmetry, from a minimum/maximum mutually spaced position to a maximum/minimum mutually spaced position.

The details of one or more variations of the subject matter described herein are set forth in the accompanying drawings and the description below. Other features and advantages of the subject matter described herein will be apparent from the description and drawings, and from the claims.

DESCRIPTION OF DRAWINGS

Further details may be obtained from the following description of a non-limiting example of embodiment of the subject of the present subject matter, provided with reference to the accompanying drawings, in which.

Like reference symbols in the various drawings indicate like elements.

DETAILED DESCRIPTION

Figure 1:
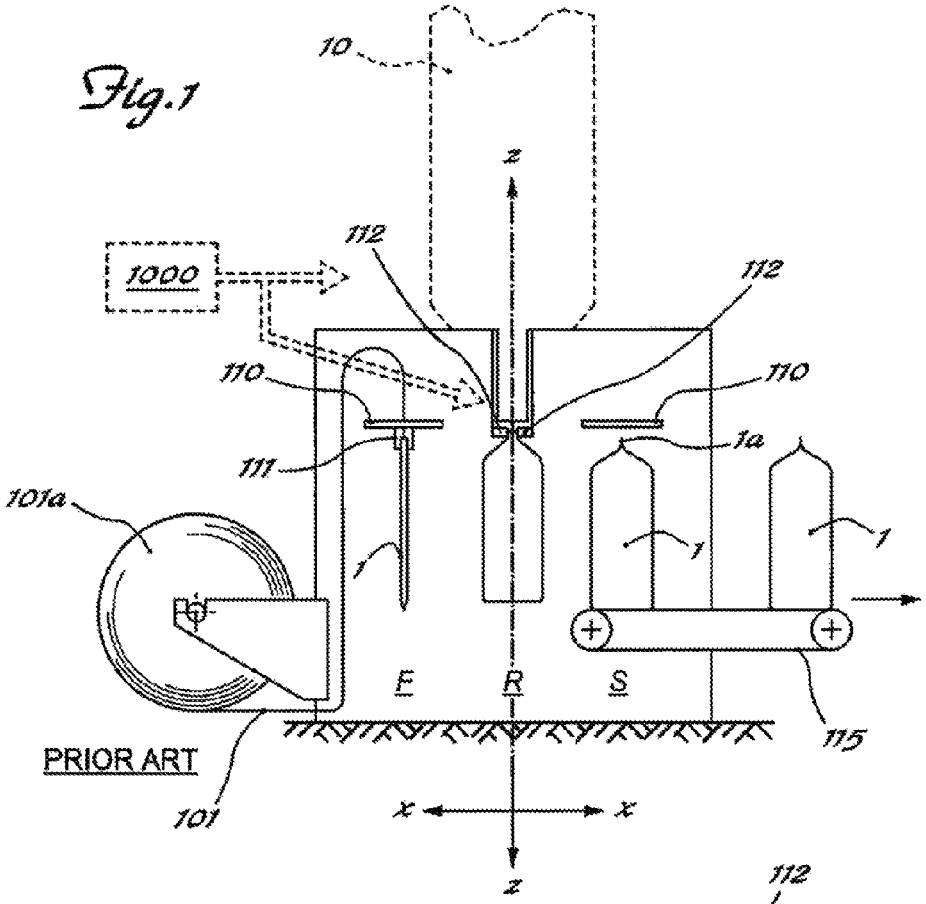
FIG. 1 shows a schematic front view of an FFS machine according to the prior art.

With reference to the figures and solely for easier description and without any limiting meaning, a set of three reference axes in a longitudinal direction Y-Y, parallel to the direction along which the width (L) of the bag is measured; transverse direction X-X, perpendicular to the preceding direction, for opening/closing the mouth of the bag; and vertical height-wise direction Z-Z, perpendicular to the other two directions and for the sake of convenience coinciding with the line traced by a central vertical plane of symmetry of the filling station R of the machine, a machine for filling bags according to the prior art is shown by way of example in FIG. 1 with an FFS machine (also indicated below by FRS) and includes a station F for forming a bag, a filling station R, and a station S for sealing.

The station F can be for forming a bag 1 from a tubular material 101, which can be wound on a reel 101*a* and unwound.

The filling station R can include:

- a hopper 110 for containing/feeding the material to be packaged in a bag;
- grippers 112 for gripping the opposite (in the longitudinal direction Y-Y) vertical edges 1*b* of the mouth 1*a* of the bag 1;
- suction cups 113 for gripping the opposite (in the transverse direction X-X) side portions 1*c* of the bag; and
- a bag-holder device with valves rotating from a rotated closing position, situated above the mouth of the bag, into a rotated opening position, inside the mouth of the bag and making sealing contact with its side portions.

The station S can be for sealing the mouth of the bag once it has been closed and a conveyor 115 for conveying the filled and sealed bag away from the machine.

With reference to FIGS. 3-6, the apparatus for adjusting opening of the bag mouth and adjusting the travel of the valves 301 of the bag-holder device according to the present subject matter can include:

- a device 200 for adjusting the distance from each other of said gripping grippers 112, comprising:
- a fixed guide 201 extending in the transverse direction Y-Y and joined to the structure 20 of the machine;
- a pair of first carriages 210 situated opposite each other and movable symmetrically with respect to the vertical central axis Z-Z, for example by means of rollers 211 travelling on said guide 201;
- each first carriage 210 is integral with a lead screw bracket 212 which is displaced on a threaded bar 213 rotated upon operation of a gearmotor 214;
- the threaded bar 213 has sections 213*a* and 213*b* which are situated opposite to each other relative to the axis of symmetry Z-Z and with opposite threading relative to each other so as to produce a relative symmetrical movement of the two carriages 210 towards/away from each other;
- each first carriage 210 also has fixed to it, in a bottom position, a flange 215 for providing an end-of-travel stop during opening of the valves 301, as will become clearer below; the flange can have a section 215*a* which is inclined downwards and towards the axis of symmetry Z-Z.
- each first carriage 210 also can have fixed to it one of the grippers 112 for gripping the opposite edges of the bag in the longitudinal direction Y-Y with jaws 112*a*, which can be movable so as to open/close in the longitudinal direction X-X in order to grip/release the vertical edges 1*b* of the mouth 1*a* of the bag;
- opening/closing of the jaws being performed by actuating means for example consisting of the rod 120 suitably displaced by a cylinder in turn connected to the respective carriage 210;
- each gripper 112 can have a body 112*b*, which can be joined to a respective second carriage 130, displaceable in the longitudinal direction Y-Y symmetrically with respect to the vertical axis Z-Z of symmetry by means of rollers 132, which can travel along a respective longitudinal guide 131 fixed to one of the two first carriages 210 to bring the grippers from a position spaced from each other into a position close together; in some implementations, the displacement of the second carriages 130 can be programmable and can be set at the start of the cycle;
- the valves 301 are hinged on a respective pin 301*a* about which they rotate in the two clockwise/anti-clockwise directions upon operation of a respective cylinder 310, which is fixed to the structure of the machine and the rod 310*a* of which is pivotably mounted on one side of the said valve 301.

According to the present subject matter, the movements for positioning the two first carriages 210, of the end-of-travel flanges 215 for rotation of the valves 301 and of the grippers 112, 112*a* for gripping the edges 1*b* of the bag 1 are coordinated and performed by means of a single start-of-cycle command depending on the width-wise dimension (L) of the bag 1. With this configuration and with reference to FIGS. 4 and 5, the operating principle of the apparatus for a bag of smaller width L indicated only by way of example as 180 mm is as follows:

- depending on the predetermined width dimension in the longitudinal direction Y-Y of the bag 1, the gearmotor 214 is operated so as to move the first carriages 210 into a position where the end-of-travel stop flanges 215 will cause a predefined opening, in the longitudinal direction Y-Y, of the valves 301 such as to ensure a sealed contact between the inner surfaces of the open mouth 1*a* of the bag 1 and the said valves;
- at the same time the grippers 112 are moved by the respective second carriage 130 into a maximum symmetrically mutually spaced position such as to close onto the vertical side edges 1*b* of the bag 1 (FIG. 6*a*);
- once gripping has been performed, the suction cups 133 are activated and, moving symmetrically away from each other in the transverse direction X-X, open the mouth 1*a* of the bag;
- during this opening movement, the grippers 112 are displaced, towards each other along longitudinal direction Y-Y, in a manner synchronized with the movement of the suction cups away from each other so as to compensate for shortening of the width of the bag following opening of its mouth;

once the bag mouth opening step has been completed the cylinder 310 is operated so as to recall into the open position the valves 301 which rotate (in an anti-clockwise position in the example shown) as far as the end-of-travel stop defined by the flanges 215, in which position the valves come into sealing contact with the mouth of the bag allowing filling of the bag without any spillage and subsequent sealing and conveying of the bag out of the machine can be performed.

Figure 6:
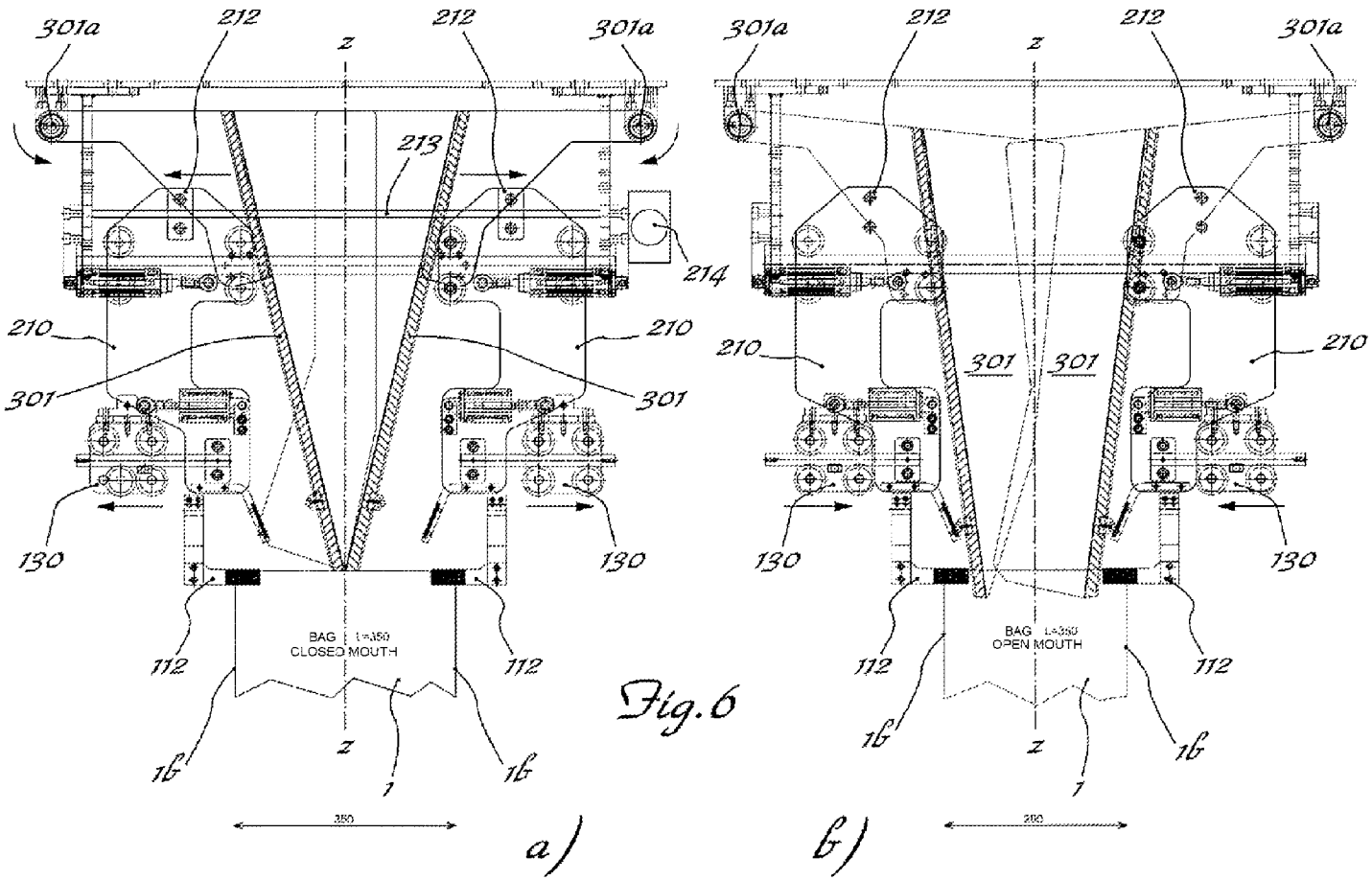
FIG. 6 shows front views similar to that of FIG. 4 of the operating sequence of the apparatus for a second larger width size of a bag.

As shown in FIG. 6, should there be a variation in the width of the bag 1, whose width L is indicated as 350 mm, the gearmotor 214 will be activated and, by means of the screw 213 and the lead screw brackets 212, will cause a relative displacement of the first carriages 210 with respect to the axis of symmetry Z-Z so that the jaws 112*a* of the grippers 112 are moved into a position such as to close onto the vertical side edges 1*b* of the bag 1 (FIG. 6*a*); correspondingly, the end-of-travel stop flanges 215 assume a new position spaced from each other with respect to the vertical axis of symmetry Z-Z, so as to produce a greater opening movement of the valves 310 (FIG. 6*b*) corresponding to the bigger size of the mouth 1*a* of the bag.

Figure 5:
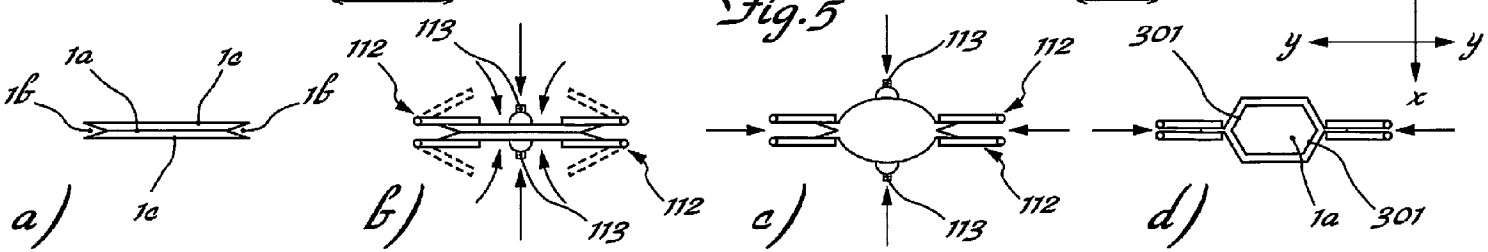
FIG. 5 shows schematic illustrations of the sequence for opening of the mouth of the bag according to FIG. 4 and entry inside it of the bag-holder valves.

In this way, once the bag mouth has been opened with a sequence similar to that described with reference to FIG. 5, the valves 301 will be able to enter into the mouth 1*a* of the bag, ensuring again the relative sealed contact between the bag walls and said valves.

As a result of the adjusting apparatus according to some implementations of the present subject matter, it is possible to adapt rapidly and without the need for disassembly and reassembly of the filling station components the relative engagement between bag mouth and bag-holder device upon variation in the width L of the bag itself. Owing to the possibility of keeping constant at the start of the cycle, the relative position with respect to the axis of symmetry Z-Z of the grippers for gripping the side edges 1*b* of the bag 1 and the end-of-travel flanges 215 for the open valves 301, as well as the movement towards each other of the grippers for gripping the edges of the bag during opening of its mouth, it is possible to ensure the sealed contact between the valves and the inner surfaces of the bag mouth for any size of the bag and without the need for structural modification of the filling station; the opening cross-section of the bag-holder device can be defined depending on the size of the bag without adversely affecting the hourly production efficiency of the machine.

As shown in FIGS. 4*b* and 6*b* and bearing in mind that the bag reaches the filling station at a height lower than that of the bag-holder device in order to avoid relative mechanical interference, with the apparatus according to the present subject matter, in which rotation of the valves until they make contact with the end-of-travel flanges also causes entry of the valves inside the bag, it is possible to avoid the need for means designed to move the entire bag-holder device or filling station in the vertical direction Z-Z with advantages of overall volume, speed and cost-savings.

In addition, some example implementations of the filling station are able to function without the need for structural modifications equally well for normal bags or bags with a gusset since the latter is no longer involved in opening of the mouth, being kept always in the closed/compressed condition by the gripping grippers.

The programming/control/actuating sequences may also be controlled by a programming device 1000 equipped with an interface for the user who may define the displacement distances of the first carriages 210 and the second carriages 130 of the grippers 112.

Figure 2:
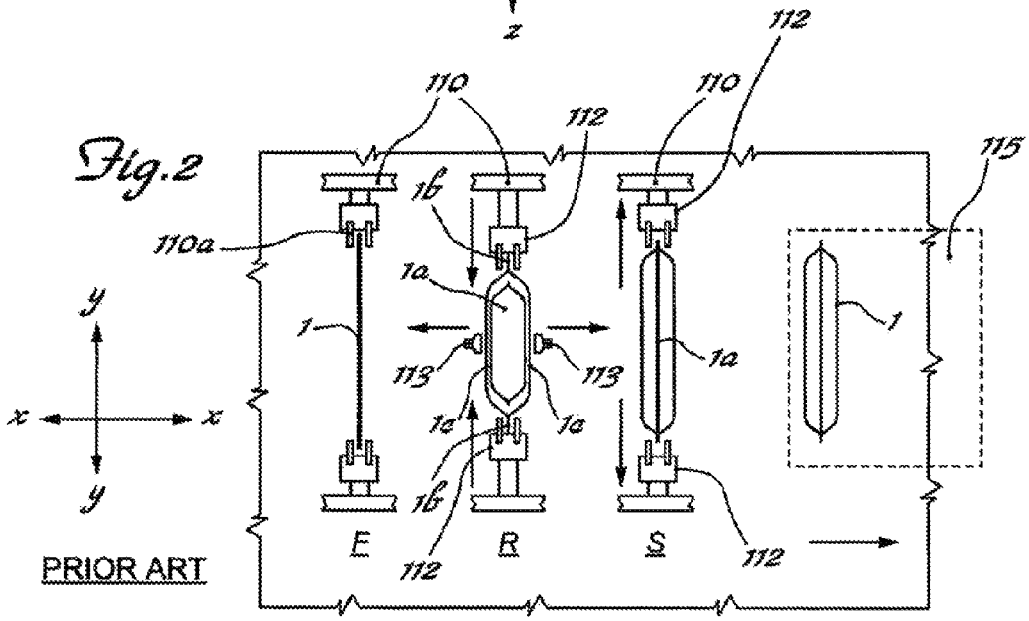
PRIOR ART Fig.2
FIG. 2 shows a simplified diagram of the working sequence of the machine according to FIG. 1.
Figure 3:
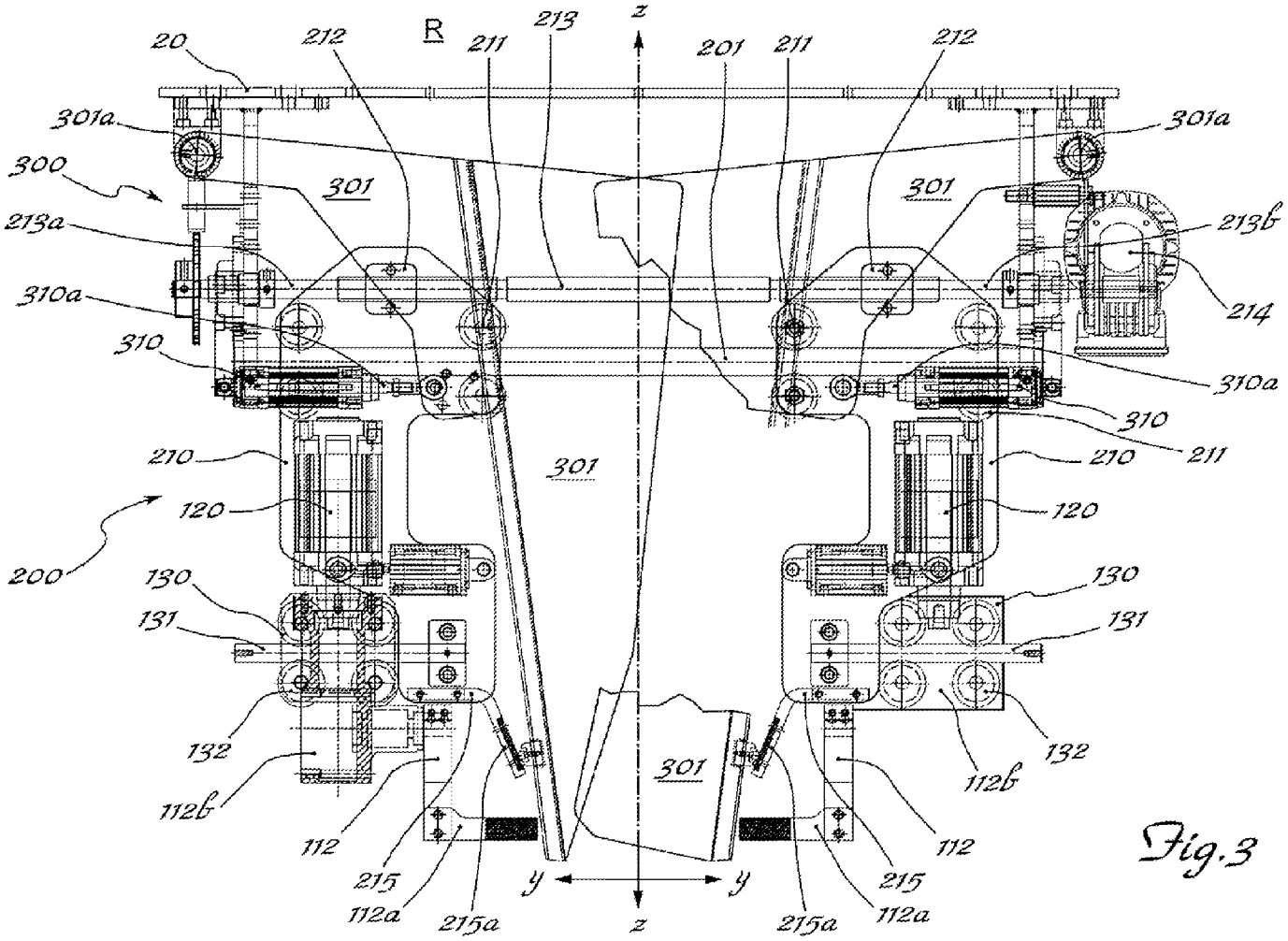
FIG. 3 shows a front view of the apparatus for adjusting the bag-holder device according to the present subject matter.
Figure 4:
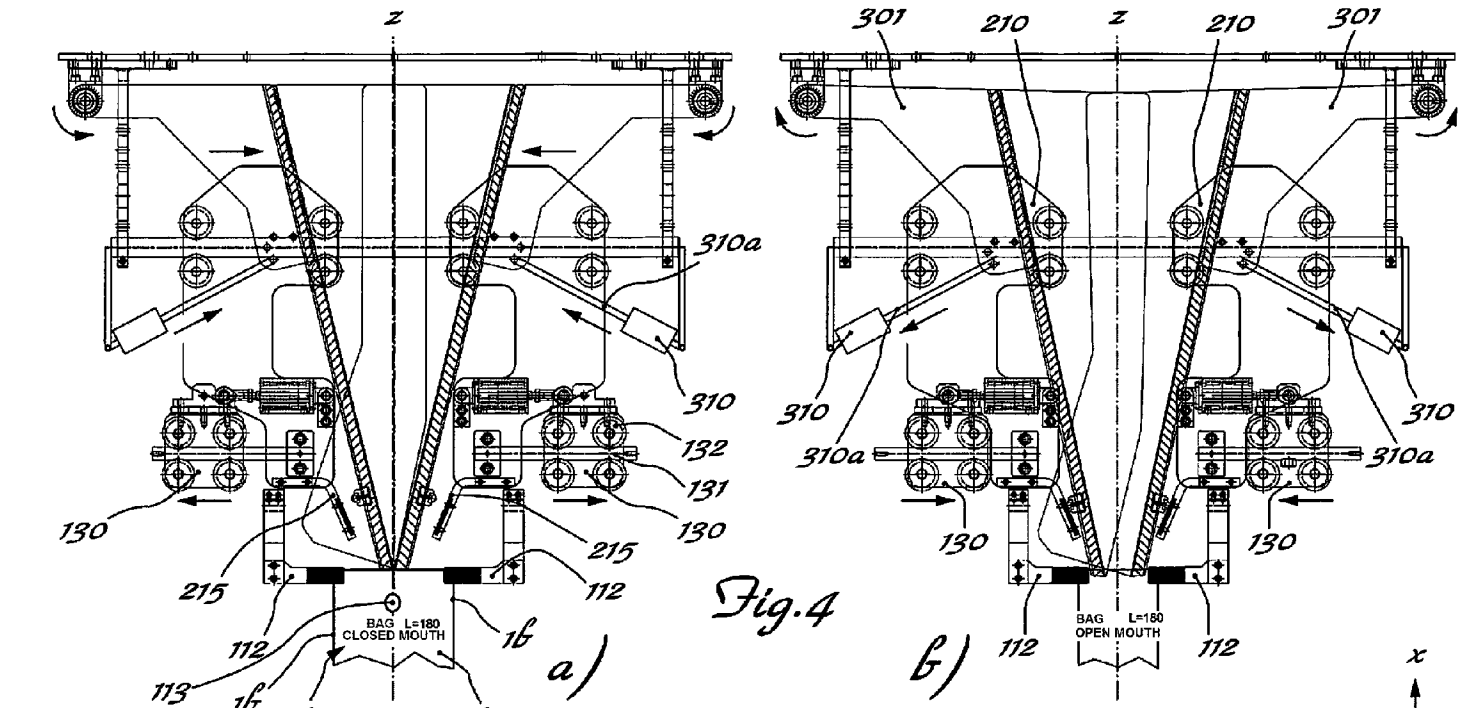
FIG. 4 shows front views, similar to that of FIG. 3, of the operating sequence of the apparatus for a first smaller width size of a bag.

Some example implementations of the present subject matter may be applied to filling machines for which the bags are pre-formed and stacked inside a store, which is associated with the machine, and from which they are removed and conveyed to the filling station. In this case the longitudinal direction Y-Y of the bag width and transverse direction X-X of the mouth opening are normally reversed compared to FIG. 2, without, however, this altering operation of the apparatus which remains the same.

In some example implementations, the movements of various parts and associated actuating operations may be replaced by technically equivalent solutions such that the displacements could be replaced by rotations and the cylinders of the valves and the second carriage can be replaced by controlled electrical actuating systems.

The measurements indicated for the width L of the bag are provided purely by way of example and are not limiting in any way.

Although described in connection with a number of embodiments and a number of preferred examples of embodiment of the present subject matter, it is understood that the scope of protection of any patent issuing from this disclosure will be determined solely by the claims.

The invention claimed is:

1. An apparatus for filling bags having a bag mouth extending in a direction of width with loose material, the apparatus comprising:

grippers for gripping opposite edges of a bag, which are arranged opposite each other relative to a vertical axis of symmetry, in a direction parallel to the direction of width of the bag;

suction cups for gripping side portions of the bag, the suction cups movable symmetrically towards and/or away from each other along a direction perpendicular to the direction of width of the bag for opening and/or gripping the bag mouth of the bag, valves rotating from a closing position outside the bag into an opening position inside the bag mouth of the bag, a pair of first carriages arranged opposite each other and movable in the direction of width of the bag symmetrically with respect to the vertical central axis of symmetry, from a minimum and/or maximum spaced position to a maximum and/or minimum spaced position, wherein fixed to each first carriage is a flange extending in the direction of width of the bag towards the vertical axis of symmetry and designed to form an adjustable stop surface for end-of-travel of rotation for opening and entry into the bag mouth of the valves, wherein each of the grippers for gripping opposite edges of the bag is supported on a respective one of the carriages, and wherein the grippers are moveable relative to the first carriages, symmetrically towards and/or away from each other with respect to said vertical axis of symmetry in a direction parallel to the direction of width of the bag;

wherein an initial relative distance with respect to the vertical axis of symmetry between the flange and the respective grippers is constant and independent of the width of the bag, and movements for initial positioning of the two first carriages, the flange for the rotation of the valves, and the grippers for gripping edges of the bag are coordinated and performed by a single start-of-cycle command depending on the width-wise dimension of the bag.

2. The apparatus according to claim 1, wherein the bag mouth is situated at a height in the vertical direction lower than that of bottom edges of the valves in the closing position.

3. The apparatus according to claim 1, wherein a travel of said first carriages is programmable at a start of a cycle depending on the width of the bag.

4. The apparatus according to claim 1, wherein each first carriage has a respective guide, which extends parallel to the direction of width and supports a respective second carriage for supporting the grippers, which is displaceable in the direction of width symmetrically with respect to the vertical axis of symmetry.

5. The apparatus according to claim 4, wherein a travel of said second carriages is fixed and independent of the width of the bag.

6. The apparatus according to claim 1, wherein the valves are hinged on a respective pin about which they rotate in both opening and/or closing directions upon operation of a cylinder which is fixed to a structure of the apparatus and a rod of which is pivotably mounted on one side of the valve.

7. The apparatus according to claim 1, wherein said first carriages are displaceable on rollers engaged on a fixed guide extending parallel to the direction of width and joined together with a structure of the apparatus.

8. The apparatus according to claim 1, wherein movement of the first carriages is performed by a gearmotor which rotationally drives a threaded bar on which two lead screw brackets respectively integral with one or the other of the two first carriages are engaged.

9. The apparatus according to claim 8, wherein the threaded bar has sections on opposite sides of the axis of symmetry with oppositely wound threading.

10. The apparatus according to claim 1, wherein said grippers have jaws movable so as to open and/or close in the direction perpendicular to the direction of width for gripping and/or releasing the side edges of the mouth of the bag, opening and/or closing of the jaws being performed by a rod suitably displaced by a cylinder in turn integral with the first carriage.

11. A method for adjusting a relative engagement between a bag mouth of a bag and valves of a filling apparatus for filling bags with loose material, the filling apparatus comprising:

grippers for gripping opposite edges of the bag, which are arranged opposite each other relative to a vertical axis of symmetry and movable symmetrically towards and/or away from each other with respect to said axis in the direction parallel to direction of width of the bag;

suction cups for gripping side portions of the bag, the suction cups movable symmetrically towards and/or away from each other along the direction perpendicular to the direction of the width of the bag for opening and/or gripping the mouth of the bag, a bag-holder device with valves rotating from a closing position outside the bag into an opening position inside the mouth of the bag, flanges arranged opposite each other and extending in the direction of width of the bag towards the axis of symmetry and designed to form an end-of-travel stop surface for opening rotation and entry into the bag mouth of the valves of the bag-holder device, wherein the flanges for rotation of the valves and the grippers for griping the edges of the bag are mounted on respective first carriages arranged opposite each other and movable, in the direction of width of the bag symmetrically with respect to the vertical central axis of symmetry, from a minimum and/or maximum mutually spaced position to a maximum and/or minimum mutually spaced position, the method comprising:

determining the width of the bag to be fed to the filling station;

symmetrically positioning, by displacing the first carriages, said flanges for the valves at a relative distance so as to determine opening of the valves in the direction of the width of the bag, such as to ensure sealing contact between inner surfaces of the open mouth of the bag and the valves;

symmetrically positioning the grippers for gripping opposite edges of the bag at a relative distance compatible with the width of the bag in order to perform gripping thereof;

feeding the bag to the filling station at a height lower than that of a bottom edge of the valves in the closing position;

gripping the opposite edges of the bag with the grippers;

moving the suction cups symmetrically away from each other in the direction perpendicular to the width of the bag, to open the mouth of the bag;

displacing the grippers towards each other in the direction parallel to the width of the bag and relative to the first carriages, so as to compensate for shortening of the width of the bag due to opening of its mouth;

rotating the valves as far as the respective end-of-travel position;

wherein an initial relative distance with respect to the axis of symmetry between the flanges and the grippers is constant and independent of the width of the bag;

wherein opening of the valves causes their movement from a position outside and above the mouth of the bag to a position inside the latter and in close contact with the inner surfaces of the said mouth; and the movements for initial positioning of the flanges for rotation of the valves and the grippers for gripping edges of the bag are coordinated and performed by a single start-of-cycle command depending on the width-wise dimension of the bag.

* * * * *